United States Patent [19]

Shelby

[11] Patent Number: 4,723,322

[45] Date of Patent: Feb. 9, 1988

[54] KNEE PAD

[75] Inventor: James E. Shelby, San Diego, Calif.

[73] Assignee: Spenco Medical Corporation, Waco, Tex.

[21] Appl. No.: 25,912

[22] Filed: Mar. 16, 1987

[51] Int. Cl.[4] ..... A41D 13/00; A41D 13/08

[52] U.S. Cl. ..... 2/24; 2/16; 2/22

[58] Field of Search ..... 2/24, 22, 16, 267; 248/346.1

[56] References Cited

U.S. PATENT DOCUMENTS

| | | | |
|---|---|---|---|
| 1,404,722 | 1/1922 | Swope . | |
| 2,124,158 | 7/1938 | Turner | 2/24 |
| 2,759,189 | 8/1956 | Cole | 2/24 |
| 2,911,757 | 11/1959 | Ciance | 248/346.1 |
| 3,044,075 | 7/1962 | Rawlings | 2/22 |
| 3,168,746 | 2/1965 | Smith | 2/24 |
| 3,259,910 | 7/1966 | Daignault | 2/24 |
| 3,458,867 | 8/1969 | Moore et al. | 2/16 |
| 4,084,584 | 4/1978 | Detty | 128/80 |
| 4,287,885 | 9/1981 | Applegate | 128/80 |
| 4,484,361 | 11/1984 | Leighton | 2/24 |
| 4,486,901 | 12/1984 | Donzis | 2/2 |
| 4,593,416 | 6/1986 | Figgie, III et al. | 2/24 |
| 4,599,747 | 7/1986 | Robinson | 2/16 |

*Primary Examiner*—Ronald Feldbaum

*Attorney, Agent, or Firm*—Donald L. Traut; Jeremiah J. Duggan

[57] ABSTRACT

A knee pad for use on a supporting surface, and not attached to a person's knee, to provide support and cushioning to a person's knee. The pad has a lower region having a bottom for contacting the supporting surface, and a contoured upper region for contacting the front portion of the person's knee. The bottom has a frictional surface to resist sliding with respect to the supporting surface. Various properties of the upper region, relating to its contours and fitting with respect to the knee, are disclosed, particularly a concavity in the top of the pad. The concavity may be vacant. The top of the concavity may adjoin the top of the pad. The concavity may have a secondary inner concavity perimeter. The pad may have a plurality of outer perimeters, defining decreasing areas within the perimeters, from bottom to top of the pad.

44 Claims, 8 Drawing Figures

KNEE PAD

BACKGROUND OF THE INVENTION

This invention pertains to cushions used to cushion and support a person's knee on a supporting surface such as a floor. Exemplary of additional supporting surfaces are chairs, benches, and steps. The invention is specifically directed at pads used to protect and support the knee during exercising, such as aerobic exercising.

In certain aerobic exercises, a person puts the knee on, for example, the floor. Since exercise programs tend to encourage vigorous activity, the vigorous activity associated with these exercises will in some cases cause the knee to impact the floor with a substantial shock.

The knee joint itself is rather prone to injury, as is well known. Indeed a plurality of cushioning pad have been developed to be attached to the knee. These pads are intended for extended periods of wearing, much like an article of clothing. U.S. Pat. Nos. 1,404,722; 2,124,158; and 2,759,189 provide knee pads worn for use in work activities that require kneeling. U.S. Pat. Nos. 3,259,910; 4,486,901; and 4,593,416 provide cushioning devices worn for use particularly in sporting events. U.S. Pat. No. 4,599,747 provides pads for wearing while breakdancing. U.S. Pat. Nos. 4,084,584; 4,287,885; and 4,484,361 teach pads for wear in medical treatment of knee problems.

While the fragile nature of the knee joint has thus been substantially addressed in protective devices to be worn for a number of uses, there remains a need for a pad which can be readily and effectively knelt on to protect the knee from shocks during exercising, and wherein the pad is not worn by the user. In each case of the references known, the pad is intended to be attached to the joint area by belts or straps, or by a constrictional brace which encompasses the entire joint area as well as the adjacent portion of the limb. See for example U.S. Pat. Nos. 4,084,584 and 4,287,885 for the bracing and 2,124,158 and 1,404,722 for typical strap attachments.

Thus, it is an object of this invention to provide a knee pad which is not attached to the knee of the user, but rather is used by placing it on the floor and kneeling on it. Acceptable pads will be capable of providing desirable levels of cushioning and support to the knee during kneeling, and particularly during exercises which use kneeling.

SUMMARY OF THE INVENTION

The invention is a pad seen, in one embodiment, for use on a supporting surface, such as the floor, to provide support and cushioning to a person's knee. This pad is also useful for supporting a person's elbow. The pad has a lower region having a bottom for contacting the floor, and a contoured upper region whose primary purpose is contacting the front of the knee. The bottom has frictional surface properties tending to resist sliding of the bottom with respect to the floor. However, the bottom surface does not stick to the floor. The upper region includes a cavity (also referred to as a "concavity" herein) configured for receiving and supporting the knee or elbow, and particularly the patella. In certain embodiments, the cavity may contain a low density, highly compressible material, such as a low density urethane foam.

The concavity has an outer perimeter, a bottom, and a top about the upper portion of the outer perimeter. Preferably the concavity is capable of providing lateral support to the knee between the top and the bottom of the concavity when the knee is placed on the pad. In a preferred embodiment, that lateral support is provided by a second inner concavity perimeter inside the outer concavity perimeter and between the top and bottom of the cavity. Preferably, the top of the concavity and the top of the pad support a front portion of the knee around the patella. This transfers the weight or shock from the patella to the tibula.

The pads of the invention have a first primary outer pad perimeter as viewed from the top. The first outer pad perimeter is in the lower region. Preferably, a second outer pad perimeter is spaced inwardly and upwardly from the first outer pad perimeter. In most preferred embodiments, a plurality of secondary outer pad perimeters is spaced inwardly and upwardly of the first outer pad perimeter, providing an appearance of steps.

The depth of the concavity from its bottom to its top is preferably no greater than about 65% of the overall thickness of the pad.

In preferred embodiments, the upper region is comprised at least in part of a cushioning section, with the cushioning section being attached to a more rigid lower section in the lower region of the pad. Where the separate cushioning section is used, it is preferred in some embodiments that the cushioning section comprise a material having a storage modulus of between 10 and 85 psi/cycle, preferably between 10 and 45 psi/cycle.

It is preferred that the outer surface of the upper region contacted by the knee be comprised of a soft, breathable, surface material for contacting the knee. The composition and structure of the pad is preferably such that nothing in the pad can migrate to the area of contact with the knee, and stain either the knee or clothing associated with the knee. Similarly the composition and structure of the pad are such that nothing in the pad can migrate to the bottom of the pad and mar the supporting surface.

With or without the various alternative elements in the previously described embodiment, it is preferred that the top of the concavity correspond with the top of the pad, so that the knee may be moved laterally from those pad surfaces supporting the front of the knee with only that clearance required to lift the knee clear of the supporting surfaces.

DETAILED DESCRIPTION OF THE ILLUSTRATED EMBODIMENTS

Figure 1:
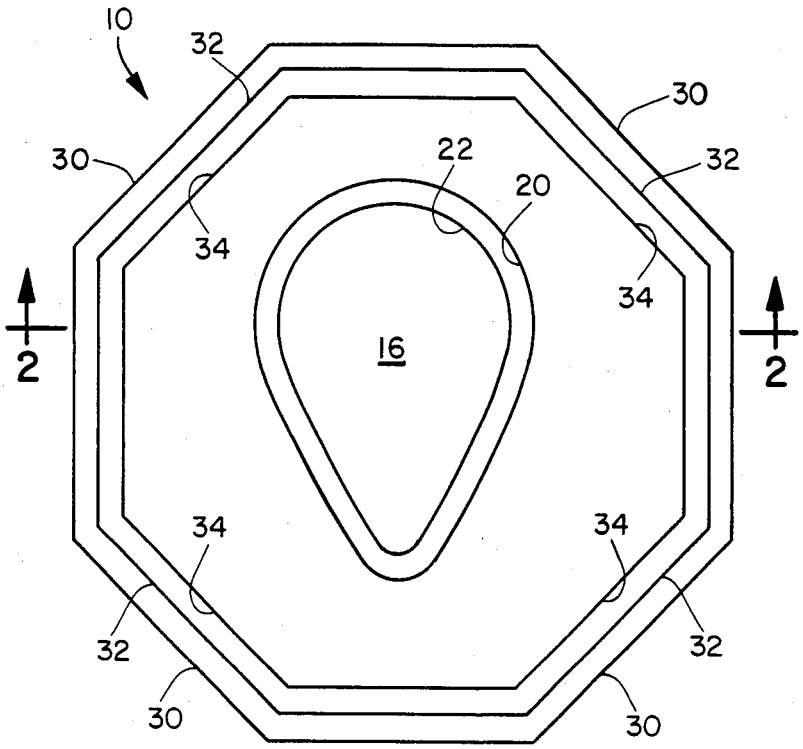
FIG. 1 is a top view of a knee pad of this invention.
Figure 2:
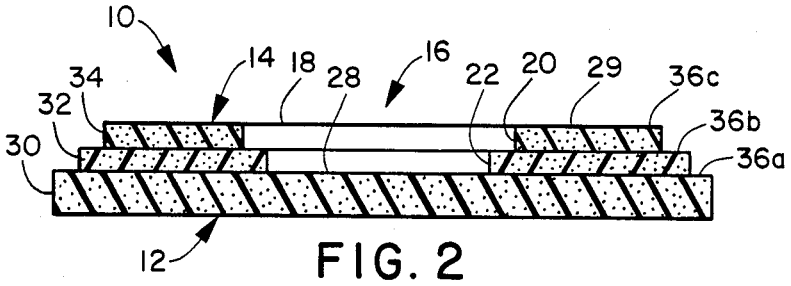
FIG. 2 is a cross section of the knee pad of FIG. 1 taken at 2—2 of FIG. 1.

A typical pad of the invention is seen in combination in FIGS. 1 and 2. The pad 10 has a lower region 12 and an upper region 14. The lower region is especially intended to rest on a supporting surface such as the floor. The upper region is intended to provide vertical and lateral cushioning support to the knee or elbow when the knee or elbow is placed on it. It is intended that the pads of the invention be placed on the floor separate from the knee then knelt on at the time that the cushioning and support is desired. In general use, the pad will be put on the floor. It may be knelt on directly, as from the standing position, or a person in the kneeling position on the floor may transfer a knee to a knee pad. Other sequences of getting the knee onto the pad will be obvious to those skilled in the art.

Figure 7:
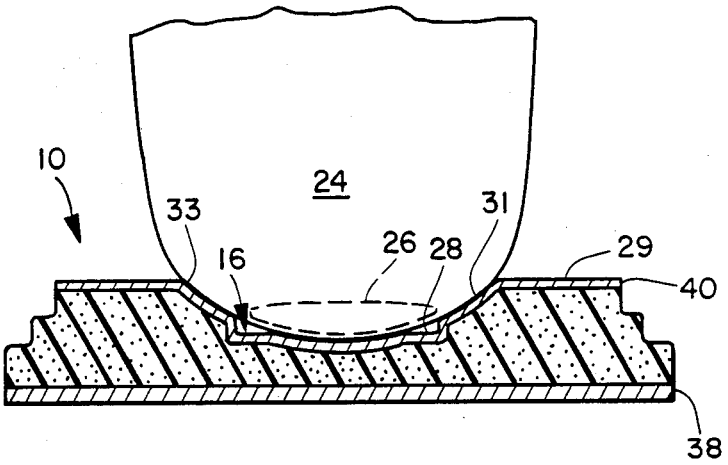
FIG. 7 is a cross-section taken at 7—7 of FIG. 6 and showing the pad of the invention vertically and laterally supporting the knee.

Referring now especially to FIGS. 1, 2, and 7, the upper region is seen to have a cavity 16 which, in many cases, is vacant. The top 18 of cavity 16 generally corresponds to the top 29 of the pad 10. Cavity 16 has a primary outer perimeter of concavity 20 and a secondary inner perimeter of concavity 22. The cavity supports knee 24 and particularly patella (knee cap) 26 both vertically and laterally. When the knee is placed on the knee pad for support, the knee 24 generally reaches to the bottom 28 of the cavity. Portions 31 and 33 of the knee adjacent the patella are generally supported in a verticle direction by the primary perimeter 20 and secondary perimeter 22 of the cavity and by the top 29 of the pad adjacent the cavity 16. Cavity 16 is generally shaped to receive and support the patella both vertically and laterally. The secondary inner perimeter 22 of cavity 16 is between top 18 and bottom 28 and inside the primary concavity perimeter 20. The combination of the top of the pad and the cavity supports generally the front portion of the knee. An advantage to the absence of side supports is that the knee may be moved laterally between the knee pad and adjacent areas of the supporting surface without raising the knee beyond the top surface 29. With typical pads, it is necessary to lift the knee above side supports in order to reposition it laterally. See, for example, upstanding walls 10 of U.S. Pat. Nos. 2,124,158 and walls 14 of 2,759,184.

The depth of the cavity 16 is generally no greater than 65%, from the top of the pad to the bottom of the pad, of the thickness of the pad. Generally the depth of the cavity will range between 40% and 65% of the pad thickness; preferably between 50% and 60%. Depths outside these ranges will work so long as (i) there is adequate cushioning material between the bottom of the cavity and the bottom of the pad to provide the needed cushioning function, and (ii) the knee need be raised only a small amount above the cushioning surface to be moved laterally off the pad.

The outer perimeter of the pad is identified by a primary outer pad perimeter 30 extending about the lower region of the pad. Secondary outer pad perimeters 32 and 34 extend inwardly and upwardly from primary outer perimeter 30.

Referring now specifically to the several embodiments shown in the drawings, FIGS. 1 and 2 represent a relatively simple embodiment of the pads of the invention. In that embodiment, three layers of an appropriately cushioning and supporting material have been laminated together as layers 36*a*, 36*b*, and 36*c*. Prior to the lamination, layers 36*b* and 36*c* have been cut to define perimeters 20 and 22 which form the perimeters of cavity 16 as best seen in FIGS. 1 and 2.

Figure 3:
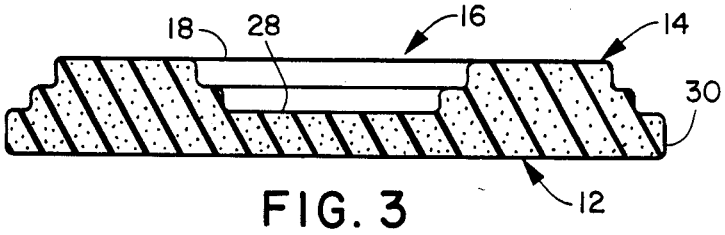
FIG. 3 shows a cross-section of an alternate embodiment of the pad of the invention wherein the pad is molded in a one piece construction.
Figure 4:
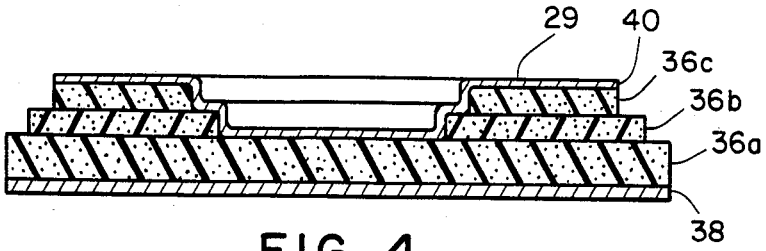
FIG. 4 is a cross section as in FIG. 2 and including additional layers on the top and bottom of pad.

FIG. 3 represents a pad similar to that of FIGS. 1 and 2, and wherein the pad has been molded as a single unit using appropriate cushioning and shock absorbing material. The materials of FIGS. 2 and 3 may be identical, with the only difference being the method of forming the pad. FIG. 4 represents a pad similar to that of FIGS. 1 and 2 and wherein additional layers 38 and 40 have been added to the bottom and top respectively. Layer 38 is a resilient, deformable base material which has less deformability than the materials used in layers 36. Layer 40 is an extensible fabric material which is added for cosmetic purposes, as well as breathability of the surface of the pad during use.

Figure 5:
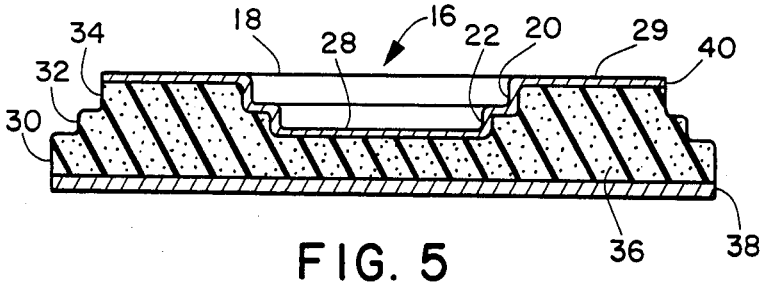
FIG. 5 is a cross-section of a pad of the invention wherein a molded cushioning body portion has top and bottom surface layers added thereto.

FIG. 5 represents a pad similar to that of FIG. 4 with the exception that the material of layer 36 has been molded as in FIG. 3 rather than having been laminated as in FIGS. 1, 2, and 4. FIG. 5 indeed represents the combination of the molding of FIGS. 3 along with the addition of layers 38 and 40 as shown in FIG. 4. The method of fabricating FIG. 5 is that layers 38 and 40 are attached to material of layer 36 in a molding process and without the use of intervening adhesives.

Figure 6:
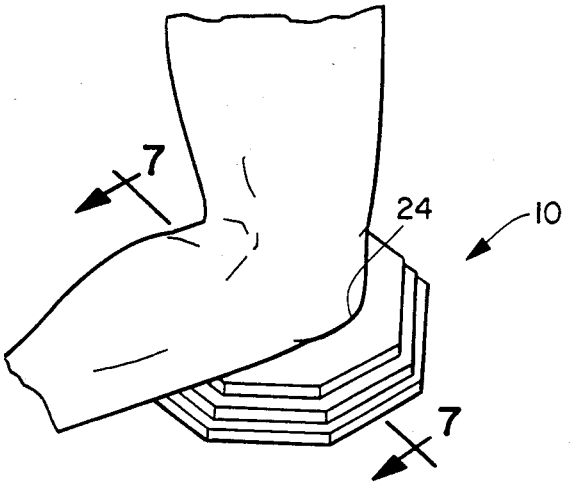
FIG. 6 shows a pictorial view of a pad of the invention with a person's knee resting on it as in normal use.

FIG. 6 pictorially shows the pad as it is conveniently used for kneeling on.

FIG. 7 shows the relationship of the cavity 16 and its contact with the knee 24, including the side support provided to the patella by the sidewalls of cavity 16.

Figure 8:
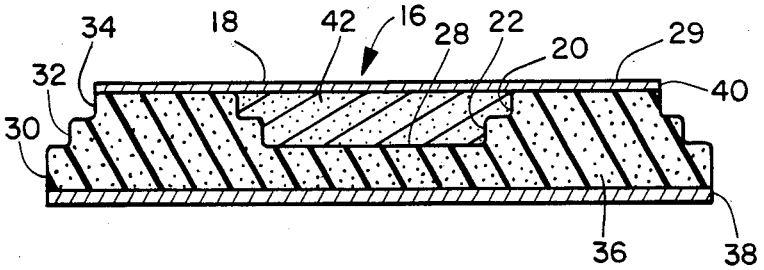
FIG. 8 is a cross-section of another embodiment of the pad of the invention showing an ultra-low density, and highly compressible material in the cavity.

FIG. 8 represents the pad having a cushioning upper section 42 in upper region 14 and a more rigid lower section in lower region 12. With respect to the cushioning material in the upper region, and particularly material 36, it is seen that the cushioning material should be soft and supportive while being able to absorb shock when the knee is placed on it, without returning that shock to the knee. Exemplary of materials which are acceptable within this context are the flexible styrene butadiene rubber foamed urethanes, foamed or blown neoprene rubbers, cross-linked polyethylene foam, and plasticized PVC foams. It is preferred that the cushioning and shock absorbing material used as at 36 in the pad, for the purpose of absorbing and cushioning the shock from the knee, have a storage modulus of 10 to 85 psi/cycle, preferably between 10 and 45. "Storage modulus" is generally defined as the amount of energy which can be bounced back toward its source. A particularly desirable urethane foam for use as material 36 is a viscoelastic polyurethane. This particular material tends to act as a fluid cushion which will distort a relatively large amount when shock forces are applied to it. A somewhat related construction for a shoe innersole is disclosed in U.S. Pat. No. 4,627,178, herein incorporated by reference.

The bottom layer 38, as seen in FIGS. 4, 5, and 7, is desirably a more rigid material which aids in the retention of the shape of the pad. The underlying material 38 in the pad is such that it resists sliding on the floor while not being so tacky as to stick to the floor. It should be understood, however, that the material of layer 38 is desirably quite flexible, and its greater rigidity is defined specifically with respect to the highly deformable and shock absorbing material of layer 36. A particularly suitable material for use in layer 38, where layer 38 is used, is an ethylene vinyl acetate.

Top layer 40 is generally a fabric such as an extensible knitted fabric which is capable of deforming in such a way it conforms to the surface as the underlying material 36 is deformed under the weight and shock of the knee 24.

In general, the boundary between the lower region 12 and the upper region 14 is defined by the top of layer 36a. The lower region 12, then, comprises a layer having generally planar top and bottom surfaces. As seen in FIG. 2, the top of layer 36a corresponds to the bottom 28 of cavity 16. It is entirely within the scope of the invention that the top of the lower region may not correspond with the bottom of cavity 16. In that regard, the entire cavity 16 is defined as residing within the upper region of the pad. Similarly, whether the bottom 28 of cavity 16 corresponds to the top of layer 36 is not particularly important, so long as the bottom of cavity 28 is defined as residing within upper region 14.

It is seen that the tops of layers 36a, 36b, and 36c form what appear to be step-like configurations in the outer perimeter of the pad. These steps are seen to be advantageous in enabling the knee to be lifted a minimal amount and transferred from the pad to an adjacent area of the floor and back with relative ease as far as being able to clear the outside perimeter of the pad.

The shape of the outer perimeter of the pad is not particularly important, so long as it provides appropriate stability to the pad and support to the knee.

The shape of the interior of cavity 16 is generally that of a tear drop in the illustrated embodiment. The purpose for that shape is to conform generally to the shape of the patella, which is similar. It is seen, especially from FIG. 7, that the side walls, and particularly the secondary inner perimeter 22 provides lateral support to the edges of the patella while the primary inner perimeter 20 of cavity 16 provides support both vertically and laterally to areas surrounding the patella. Thus the dual perimeters 20 and 22 function to spread the vertical and lateral support outwardly from the patella, thus taking some of the stress off the fragile patella itself, and spreading it to the surrounding portions of the front of the knee. Other shapes for the interior of cavity 16 are seen to be acceptable, so long as they provide appropriate support to the knee, and make some provision for spreading at least part of the vertical force away from the patella.

As seen in FIG. 7 the highly deformable shock absorbing material 16 may extend into the lower region 12 of the pad. Similarly, the more rigid material 38 may extend into the upper region of the pad, so long as there is sufficient of the shock absorbing material 36 around the area contacted by knee 24 to provide appropriate cushioning for the knee.

FIG. 8 shows, in cross-section, an embodiment of the pad wherein cavity 16 is filled with a more compressible material 42 than the cushioning material 36. The fabric top layer 40 extends across the top of the compressible material 42 rather than down into the cavity 16 as in FIG. 4. In the embodiment of FIG. 8, material 42 is used primarily for the purpose of filling the cavity. It should have minimal resistance to deformative force and preferably is viscoelastic. Thus, a soft urethane foam having a density of, for example, 1 pound per cubic foot (PCF) to 4 PCF is acceptable for material 42. It is important that any material 42 in cavity 16 have substantially less resistance to deformation than the adjacent cushioning material 36. This will ensure that vertical forces adjacent the cavity 16 will tend to be directed toward the cavity, the same as if the cavity 16 were vacant.

In the embodiments using the materials 36, 38, and 40, material 36 provides the primary cushioning and shock absorbing properties of the pad. It is entirely possible that material 36 comprise a plurality of layers of material surrounding cavity 16 and having a greater or lesser cushioning and shock absorbing capabilities, under compressive shock and forces, than the cushioning and shock absorbing material immediately surrounding cavity 16. The composite of these one or more materials, or material layers, surrounding cavity 16, which provides the primary cushioning and shock absorbing capabilities is defined as the cushioning section of the pad, and applies to all the embodiments having the capability of encompassing the plurality of materials.

In the overall construction of the pads of the invention, no material is able to migrate to the bottom surface 31 of the pad and mar the floor. Thus, while any number of materials capable of marring the floor might be used for layer 36, the material of layer 38, and any material which could migrate through it must be such that it will not have any detrimental effect on the underlying floor.

Similarly the construction of the pad is such that no material can migrate to knee and stain either the knee or associated clothing. Particularly with regard to the rubbers, some of the highly carbon-filled rubbers would tend to leave black marks on either the floor or the knee, or clothing, if they were exposed to those surfaces. Thus such materials must be carefully shielded from both the floor and the knee.

The pads of the invention provide the capability to support the knee and cushion it from both vertical and lateral shocks without having to actually attach the pad to the knee. Exercises can be performed on the pad without attaching the pad. The pads can be readily moved from place to place, or transferred from person to person without any need to attach or detach the pads to any particular person or structure.

Thus, it is seen that the pads of the invention are useful for supporting the knee and for absorbing and cushioning the shock from vigorous exercise activity when the knee is placed on the pad on a floor, or other supporting surface.

Having thus described the invention, what is claimed is:

1. A pad for use on a supporting surface to provide cushioning to a person's knee, said pad comprising a lower region having a bottom for contacting said supporting surface, and a contoured upper region for contacting the front of said knee, said bottom comprising frictional surface tending to resist sliding of said bottom with respect to said supporting surface, said upper region including a concavity configured for receiving and supporting said knee.

2. A pad as in claim 1 wherein said concavity is configured to receive the patella of said knee.

3. A pad as in claim 1 or 2 wherein said concavity has an outer perimeter, a bottom, and a top about said outer perimeter, and wherein said concavity is capable of providing lateral support to said knee between said top and said bottom of said concavity.

4. A pad as in claim 3 wherein at least a portion of said lateral support is provided by a secondary inner concavity perimeter inside said outer concavity perimeter and disposed between said top and said bottom of said concavity.

5. A pad as in claim 3 wherein said top of said concavity is configured for supporting a front portion of said knee.

6. A pad as in claim 4 wherein sid top of said concavity is configured for supporting a front portion of said knee.

7. A pad as in claim 1 or 2, said pad having a first primary outer pad perimeter as viewed from the top, said first outer pad perimeter being in said lower region, and a second outer pad perimeter spaced inwardly and upwardly of said first outer pad perimeter.

8. A pad as in claim 3, said pad having a first primary outer pad perimeter as viewed from the top, said first outer pad perimeter being in said lower region, and a second outer pad perimeter spaced inwardly and upwardly of said first outer pad perimeter.

9. A pad as in claim 5, said pad having a first primary outer pad perimeter as viewed from the top, said first outer pad perimeter being in said lower region, and a second outer pad perimeter spaced inwardly and upwardly of said first outer pad perimeter.

10. A pad as in claim 6, said pad having a first primary outer pad perimeter as viewed from the top, said first outer pad perimeter being in said lower region, and a second outer pad perimeter spaced inwardly and upwardly of said first outer pad perimeter.

11. A pad as in claim 1 or 2, said pad having a first primary outer pad perimeter as viewed from the top, said first outer pad perimeter being in said lower region, and a plurality of secondary outer pad perimeters spaced inwardly and upwardly of said first outer pad perimeter.

12. A pad as in claim 1 or 2 and having a cushioning section in said upper region attached to a more rigid lower section.

13. A pad as in claim 12 wherein said cushioning section comprises a material having a storage modulus of between 10 and 85 psi/cycle.

14. A pad as in claim 12 and including, in the area of said upper region contacted by said knee, a soft, breathable surface material for contacting said knee, the composition and structure of said pad being such that nothing in said pad can migrate to said area of contact and stain said knee or associated clothing.

15. A pad as in claim 1 or 2, the composition and structure of said pad being such that nothing in said pad can migrate to said bottom of said pad and mar said supporting surface.

16. A pad as in claim 4 wherein the depth of said concavity, from said bottom of said concavity to said top thereof, is no greater than about 65% of the overall thickness of said pad.

17. A pad of claim 1 wherein said concavity having an outer concavity perimeter, a bottom, and a top about said outer concavity perimeter, wherein said top of said concavity adjoins the top of said pad and wherein said top of said concavity is configured for supporting a front portion of said knee.

18. A pad as in claim 17 wherein said concavity is capable of providing lateral support to said knee between said top and said bottom of said concavity.

19. A pad as in claim 18 wherein at least a portion of said lateral support is provided by a secondary inner concavity perimeter inside said outer concavity perimeter and disposed between said top and said bottom of said concavity.

20. A pad as in claim 17, 18, or 19, said pad having a first primary outer pad perimeter as viewed from the top, said first outer pad perimeter being in said lower region, and a second outer pad perimeter spaced inwardly and upwardly of said first outer pad perimeter.

21. A pad as in claim 17 or 18 and having a cushioning section in said upper region attached to a more rigid lower section.

22. A pad as in claim 21 wherein said cushioning section comprises a material having a storage modulus of between 10 and 85 psi/cycle.

23. A pad as in claim 21 and including, in the area of said upper region contacted by said knee, a soft, breathable surface material for contacting said knee, the composition and structure of said pad being such that nothing in said pad can migrate to said area of contact and stain said knee or associated clothing.

24. A pad as in claim 17, the composition and structure of said pad being such that nothing in said pad can migrate to that portion of said lower region in contact with said supporting surface and mar said supporting surface.

25. A pad as in claim 19 wherein the depth of said concavity, from said bottom of said concavity to said top thereof, is no greater than about 65% of the overall thickness of said pad.

26. A pad of claim 1 wherein said concavity having an outer concavity perimeter, a bottom, a top about said outer concavity perimeter, and a secondary inner concavity perimeter inside said outer concavity perimeter, and disposed between said top and said bottom of said concavity.

27. A pad as in claim 26 wherein said top of said concavity supports a front portion of said knee.

28. A pad as in claim 26 or 27, said pad having a first primary outer pad perimeter as viewed from the top, said first outer pad perimeter being in said lower region, and a second outer pad perimeter spaced inwardly and upwardly of said first outer pad perimeter.

29. A pad as in claim 26 or 27 and having a cushioning section in said upper region attached to a more rigid lower section.

30. A pad as in claim 29 wherein said cushioning section comprises a material having a storage modulus of between 10 and 85 psi/cycle.

31. A pad as in claim 29 and including, in the area of said upper region contacted by said knee, a soft, breathable surface material for contacting said knee, the composition and structure of said pad being such that nothing in said pad can migrate to said area of contact and stain said knee or associated clothing.

32. A pad as in claim 26 the composition and structure of said pad being such that nothing in said pad can migrate to said bottom of said pad and mar said supporting surface.

33. A pad as in claim 26 wherein the depth of said concavity, from said bottom of said concavity to said top thereof, is no greater than about 65% of the overall thickness of said pad.

34. A pad as in claim 1 wherein said pad having a first primary outer pad perimeter as viewed from the top, said first outer pad perimeter being in said lower region, and a second outer pad perimeter spaced inwardly and upwardly of said first outer pad perimeter.

35. A pad as in claim 34, said pad having a cushioning section in said upper region attached to a more rigid lower section.

36. A pad as in claim 35 wherein said cushioning section comprises a material having a storage modulus of between 10 and 85 psi/cycle.

37. A pad as in claim 35 and including, in the area of said upper region contacted by said knee, a soft, breathable surface material for contacting said knee, the composition and structure of said pad being such that nothing in said pad can migrate to said area of contact and stain said knee or associated clothing.

38. A pad as in claim 34, the composition and structure of said pad being such that nothing in said pad can migrate to said bottom of said pad and mar said supporting surface.

39. A pad as in claim 12 wherein said cushioning section comprises a material having a storage modulus of between 10 and 15 psi/cycle.

40. A pad as in claim 29 wherein said cushioning section comprises a material having a storage modulus of between 10 and 45 psi/cycle.

41. A pad as in claim 35 wherein said cushioning section comprises a material having a storage modulus of between 10 and 45 psi/cycle.

42. A pad as in claim 1 wherein said upper region including an internal concavity configured for receiving and supporting said knee, said internal concavity having an outer concavity perimeter, a bottom, and a top about said outer concavity perimeter, said internal concavity being filled with a fill material, said fill material being more readily deformable, under compressive shock and forces, than the material surrounding said concavity.

43. A pad as in claim 42 wherein said internal concavity is configured to receive the patella of said knee.

44. A pad as in claim 42 or 43 wherein said internal concavity is capable of providing lateral support to said knee between said top and said bottom of said internal concavity.

* * * * *